US012687355B2

(12) United States Patent
Brown

(10) Patent No.: US 12,687,355 B2
(45) Date of Patent: Jul. 21, 2026

(54) FIREARM WITH INTEGRATED LOWER RECEIVER COMPONENTS

(71) Applicant: XCAL IP LLC, Ashburn, VA (US)

(72) Inventor: Jason Kiyoshi Brown, Chantilly, VA (US)

(73) Assignee: XCAL IP LLC, Ashburn, VA (US)

( * ) Notice: Subject to any disclaimer, the term of this patent is extended or adjusted under 35 U.S.C. 154(b) by 0 days.

(21) Appl. No.: 19/064,817

(22) Filed: Feb. 27, 2025

(65) Prior Publication Data

US 2025/0277638 A1 Sep. 4, 2025

Related U.S. Application Data

(60) Provisional application No. 63/560,655, filed on Mar. 2, 2024.

(51) Int. Cl.
*F41A 3/66* (2006.01)
*F41A 17/36* (2006.01)

(52) U.S. Cl.
CPC ..... *F41A 3/66* (2013.01); *F41A 17/36* (2013.01)

(58) Field of Classification Search
CPC .. F41A 3/66; F41A 17/36; F41A 17/40; F41A 17/42
USPC ..... 42/18
See application file for complete search history.

(56) References Cited

U.S. PATENT DOCUMENTS 9,927,193 B2 * 3/2018 Beasley ..... F41A 9/71
D816,180 S * 4/2018 Farris ..... D22/108
10,018,437 B2 * 7/2018 Phipps ..... F41A 17/42
10,180,298 B2 * 1/2019 Noonan ..... F41A 17/36
10,591,234 B2 3/2020 Beasley
11,085,715 B2 * 8/2021 Stroda ..... F41A 3/68
11,940,239 B2 * 3/2024 Stroda ..... F41A 3/68
2017/0160032 A1 * 6/2017 Overstreet ..... F41A 17/36
2017/0241729 A1 * 8/2017 Gangl ..... F41A 3/66
2017/0299303 A1 * 10/2017 Phipps ..... F41A 17/36
(Continued)

OTHER PUBLICATIONS

Wilson Combat, "The AR9 Optimized Recoil System from Wilson Combat.," https://www.youtube.com/watch?v=BP9MszeGpSY, Published Oct. 6, 2022, Accessed Feb. 14, 2025.
(Continued)

*Primary Examiner* — John Cooper
(74) *Attorney, Agent, or Firm* — Bennet K. Langlotz; Langlotz Patent & Trademark Works, LLC

(57) ABSTRACT

Firearms with integrated lower receiver components have a bolt hold open element movably connected to a frame to the rear of a magazine well and configured to move between a protruding position operable to restrain a bolt assembly rearward of the magazine well, and a retracted position operable to enable the bolt assembly to move forward beyond a rear portion of the magazine well, an elongated link connected to the bolt hold open element, a forward portion of the elongated link extending forward of the magazine well and having an actuator portion extending above the magazine well and configured to be actuated by a magazine follower, the elongated link having a first elongated portion received by the frame to rotate, the elongated link having an arm extending laterally from the first elongated portion and having a free end movable between an elevated and lowered position and including the actuator portion.

18 Claims, 6 Drawing Sheets

(56) References Cited

U.S. PATENT DOCUMENTS

2020/0182571 A1* 6/2020 Noonan ..... F41A 3/66
2024/0361095 A1 10/2024 Brown

OTHER PUBLICATIONS

Wilson Combat, "Owner's Manual for AR9," Copyright 2019.

* cited by examiner

FIREARM WITH INTEGRATED LOWER RECEIVER COMPONENTS

CROSS-REFERENCE TO RELATED APPLICATION

This application claims the benefit of U.S. Provisional Patent Application No. 63/560,655 filed on Mar. 2, 2024, entitled "3-IN-1 LOWER RECEIVER INSERT," which is hereby incorporated by reference in its entirety for all that is taught and disclosed therein.

FIELD OF THE INVENTION

The present invention relates to firearms, and more particularly to a firearm with integrated lower receiver components that enables integration of the bolt catch, torsion rod, and feed ramp into a single unit prior to installation in the lower receiver of the firearm.

BACKGROUND AND SUMMARY OF THE INVENTION

Firearms traditionally have separate components for the bolt catch, last round bolt hold trip lever, and feed ramp. These components are handled separately from one another in manufacturing and in installation into a standard firearm lower receiver. This approach has the disadvantages of making the manufacture and assembly of a complete firearm lower receiver more complex, expensive, and time consuming.

Therefore, a need exists for a new and improved firearm with integrated lower receiver components that enables integration of the bolt catch, torsion rod, and feed ramp into a single unit prior to installation in the lower receiver of the firearm. In this regard, the various embodiments of the present invention substantially fulfill at least some of these needs. In this respect, the firearm with integrated lower receiver components according to the present invention substantially departs from the conventional concepts and designs of the prior art, and in doing so provides an apparatus primarily developed for the purpose of enabling integration of the bolt catch, torsion rod, and feed ramp into a single unit prior to installation in the lower receiver of the firearm.

The present invention provides an improved firearm with integrated lower receiver components, and overcomes the above-mentioned disadvantages and drawbacks of the prior art. As such, the general purpose of the present invention, which will be described subsequently in greater detail, is to provide an improved firearm with integrated lower receiver components that has all the advantages of the prior art mentioned above.

To attain this, the preferred embodiment of the present invention essentially comprises a frame having a barrel extending in a forward direction and defining a bolt passage configured to receive a reciprocating bolt assembly, the frame defining a magazine well, a bolt hold open element movably connected to the frame to the rear of the magazine well and configured to move between a protruding position operable to restrain the reciprocating bolt assembly rearward of the magazine well, and a retracted position operable to enable the reciprocating bolt assembly to move forward beyond a rear portion of the magazine well, an elongated link connected to the bolt hold open element, a forward portion of the elongated link extending forward of the magazine well and having an actuator portion extending above the magazine well and configured to be actuated by a magazine follower, the elongated link having a first elongated portion defining a link axis and received by the frame to rotate about the link axis, the elongated link having an arm extending laterally from the first elongated portion and having a free end movable between an elevated and lowered position, and the free end of the arm including the actuator portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
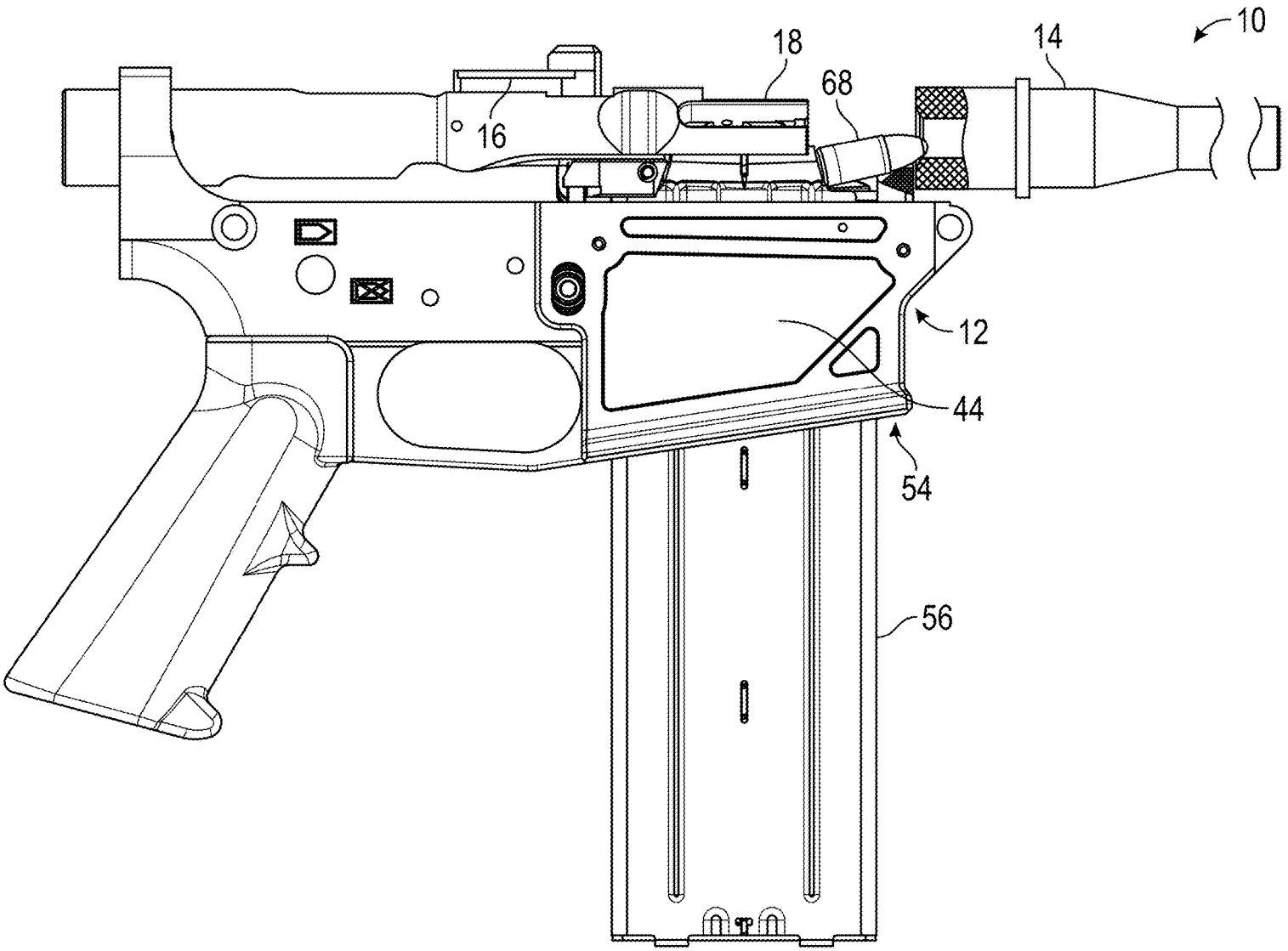
FIG. 1 is a right side view of the current embodiment of a firearm with integrated lower receiver components constructed in accordance with the principles of the present invention with a portion of the frame and barrel cutaway.
Figure 2:
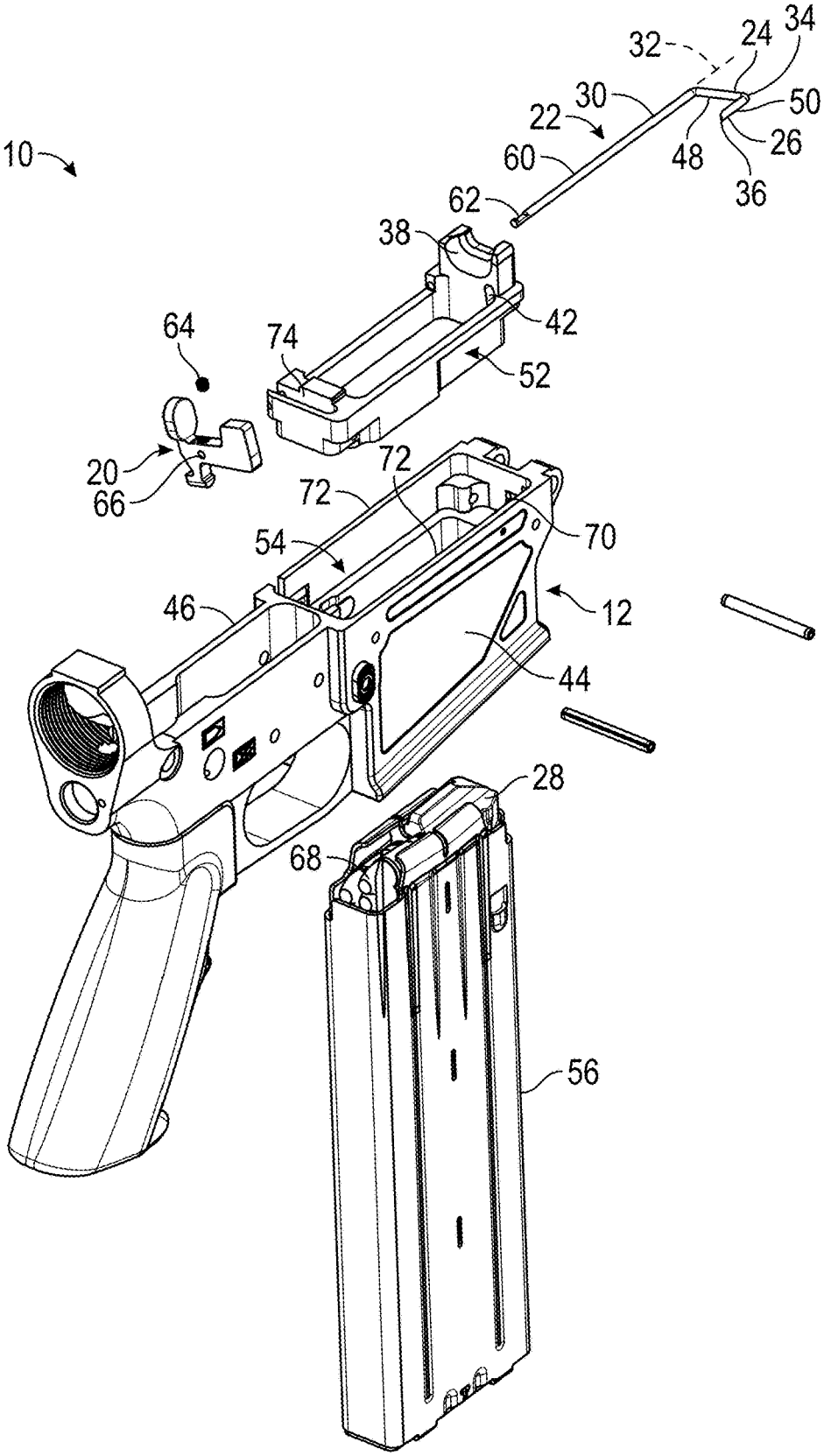
FIG. 2 is an exploded view of the firearm with integrated lower receiver components of FIG. 1.
Figure 3:
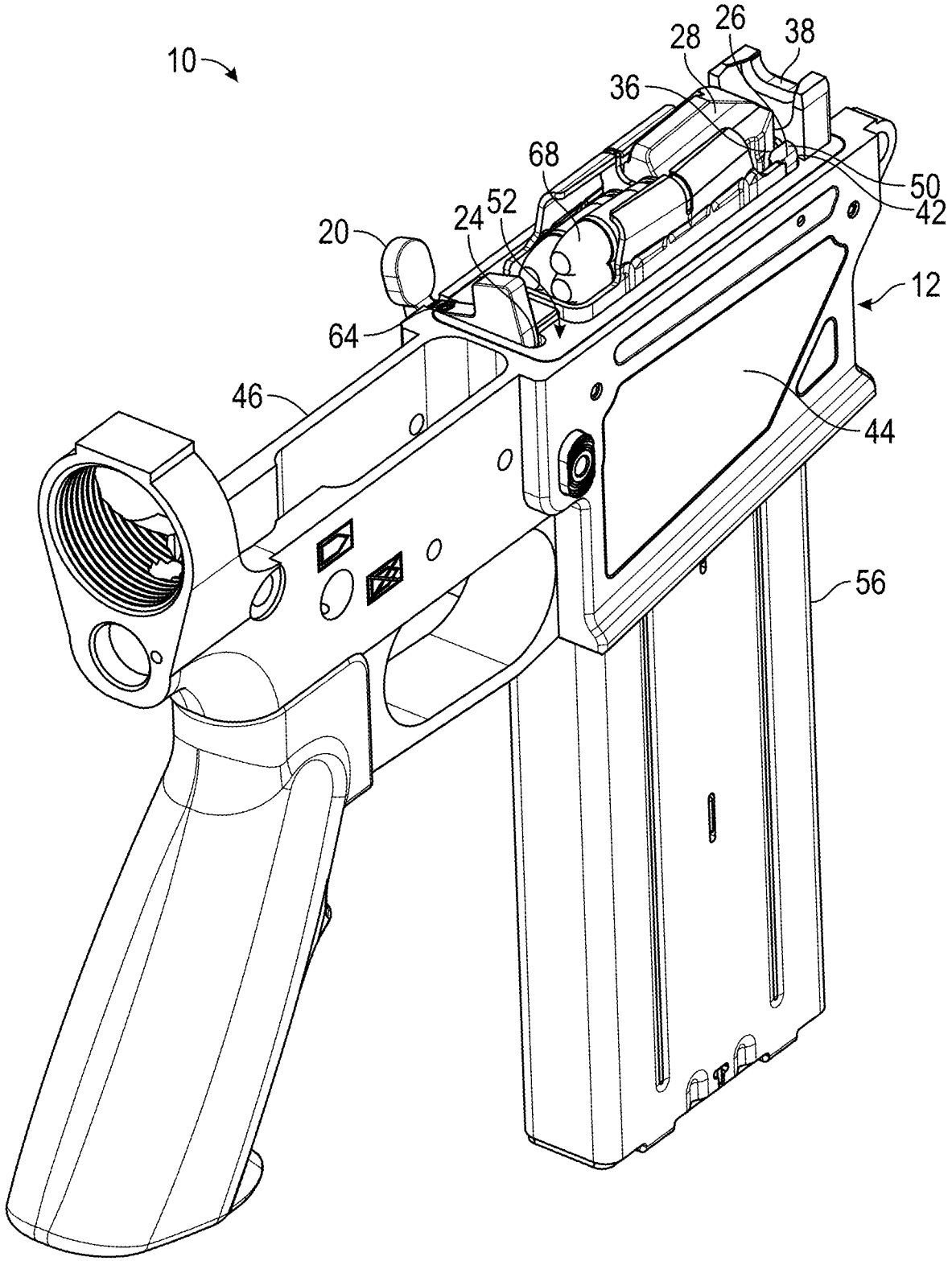
FIG. 3 is a rear isometric view of the lower receiver of the firearm with integrated lower receiver components of FIG. 1.

An embodiment of the firearm with integrated lower receiver components of the present invention is shown and generally designated by the reference numeral 10.

FIGS. 1-3 & 6A-B illustrate the improved firearm with integrated lower receiver components 10 of the present invention. More particularly, the firearm with integrated lower receiver components has a frame 12 in the form of a lower receiver having a barrel 14 extending in a forward direction and defining a bolt passage 16 configured to receive a reciprocating bolt assembly 18. The frame defines a magazine well 54. A bolt hold open element 20 is movably connected to the frame to the rear of the magazine well and is configured to move between a protruding position operable to restrain the reciprocating bolt assembly rearward of the magazine well (shown in FIG. 3), and a retracted position operable to enable the reciprocating bolt assembly to move forward beyond a rear portion of the magazine well (shown in shown in FIG. 4B). An elongated link 22 is connected to the bolt hold open element. A forward portion 24 of the elongated link extends forward of the magazine well and has an actuator portion 26 extending above the magazine well and configured to be actuated by a magazine follower 28. The elongated link has a first elongated portion 30 defining a link axis 32 and received by the frame to rotate about the link axis. The elongated link has an arm 34 extending laterally from the first elongated portion and having a free end 36 movable between an elevated and lowered position. The free end of the arm includes the actuator portion in the current embodiment.

In the current embodiment, the elongated link 22 is a rod having a circular cross-sectional profile. Preferably, the entire elongated link has a circular cross-sectional profile. The rod extends to the actuator portion 26. A rear portion 60 of the elongated link defines a flat 62. A set screw 64 secures the rear portion of the elongated link within an aperture 66 defined by the bolt hold element 20. The frame 12 includes a feed ramp element 38 at a forward portion 40 of the magazine well 54. The feed ramp element defines an aperture 42 receiving the actuator portion of the elongated link.

The frame 12 has a left side 44 and a right side 46. The first elongated portion 30 of the elongated link 22 is left of the magazine well 54, and the actuator portion 26 is above a right portion 70 of the magazine well. The magazine well has a width 72, and the arm 34 has a length at least ¾ of the width of the magazine well. Preferably, the arm extends the width of the magazine well. The elongated link includes a second portion 48 extending laterally from the first elongated portion, and a third portion 50 extending rearward from the second portion.

It should be appreciated that the portion of the frame 12 including the feed ramp element 38 can be a lower receiver insert 52 that receives the bolt hold open element 20 in a slot 74 and the elongated link 22 to form a single unit that is installed in the frame that integrates the feed ramp element, the bolt hold open element, and the elongated link. The bolt hold open element physically stops the reciprocating bolt assembly 18 from closing when a magazine 56 received in the magazine well 54 runs out of ammunition 68.

Figure 4A:
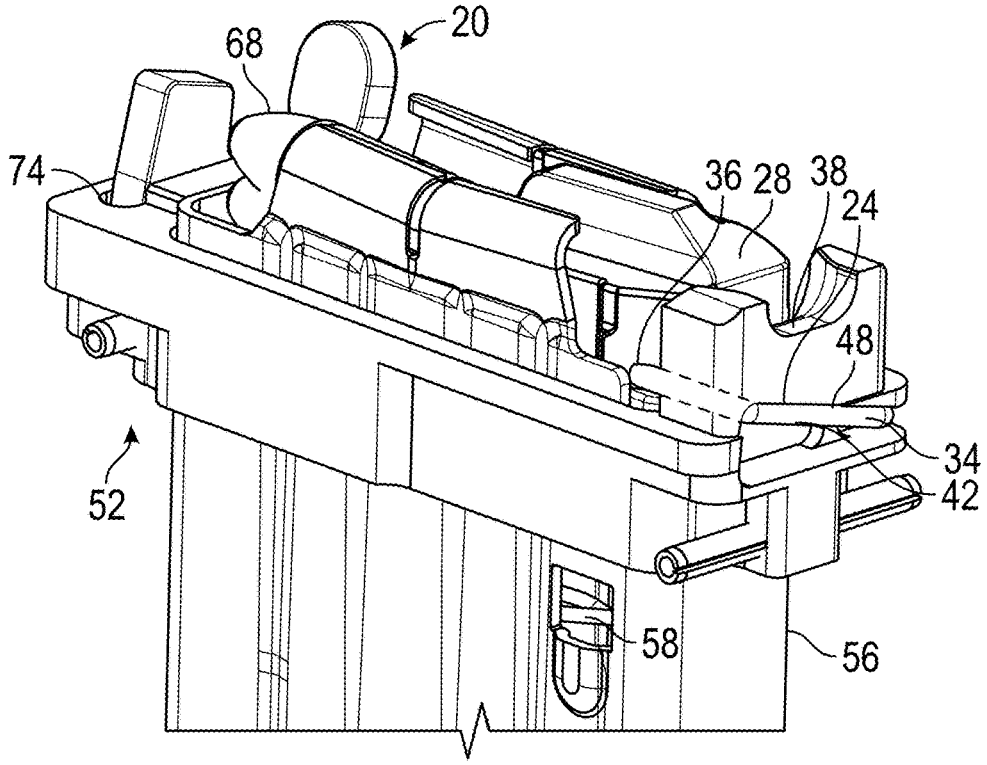
FIG. 4A is a front isometric enlarged view of the lower receiver insert of the firearm with integrated lower receiver components of FIG. 1 with the bolt hold open element in the protruding position.
Figure 4B:
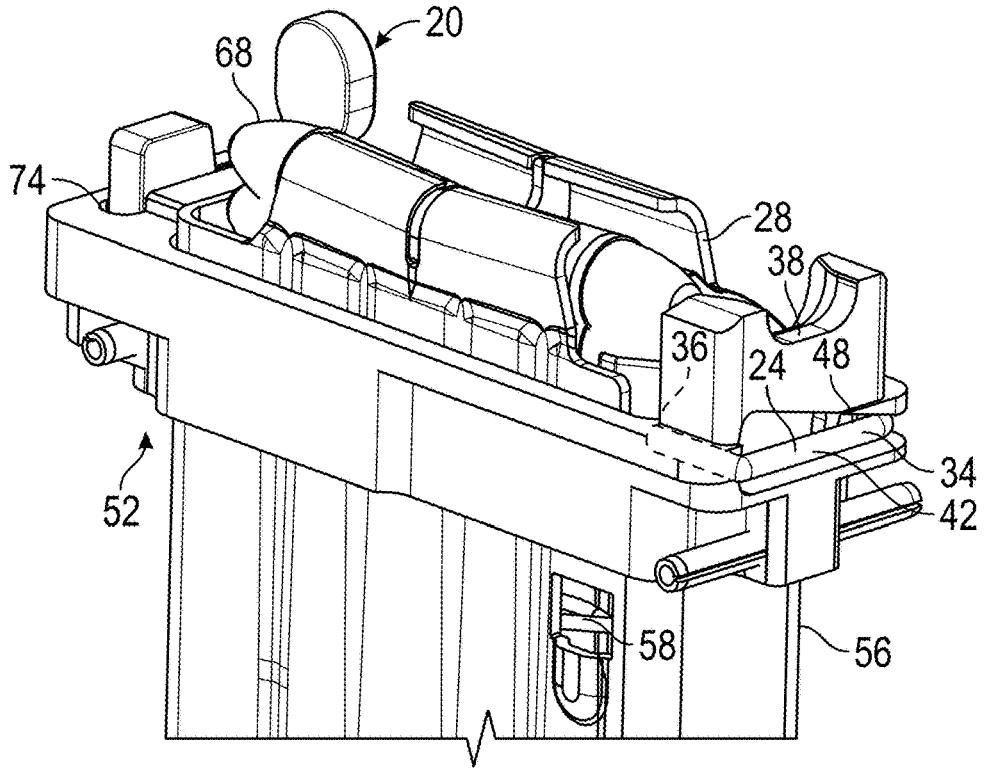
FIG. 4B is a front isometric enlarged view of the lower receiver insert of the firearm with integrated lower receiver components of FIG. 1 with the bolt hold open element in the retracted position.
Figure 5:
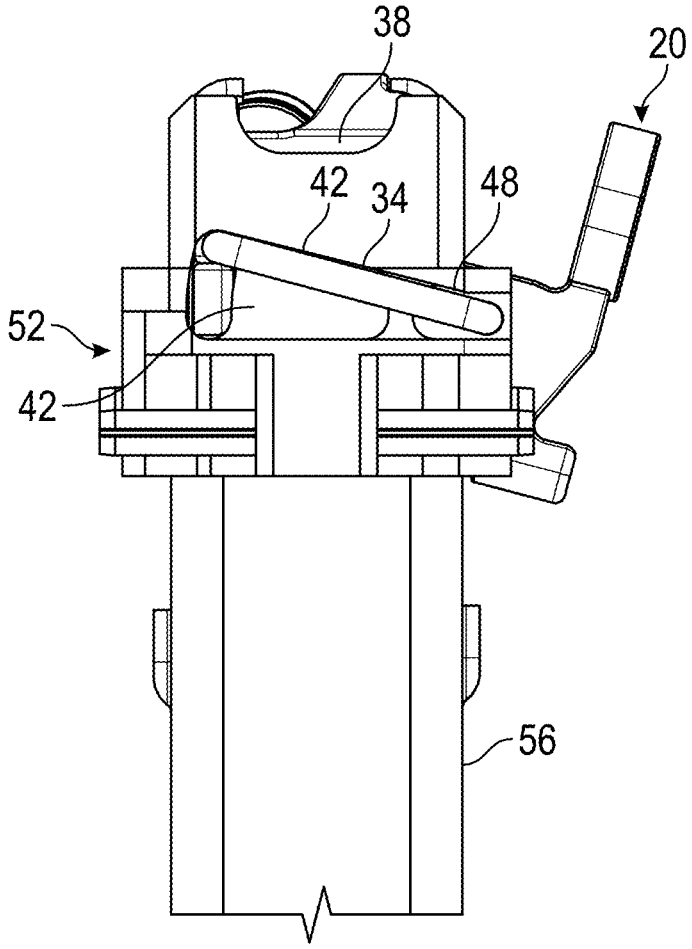
FIG. 5 is a front enlarged view of the lower receiver insert of the firearm with integrated lower receiver components of FIG. 1 with the bolt hold open element in the protruding position in solid lines and with the bolt hold open element in the retracted position in dashed lines.
Figure 6A:
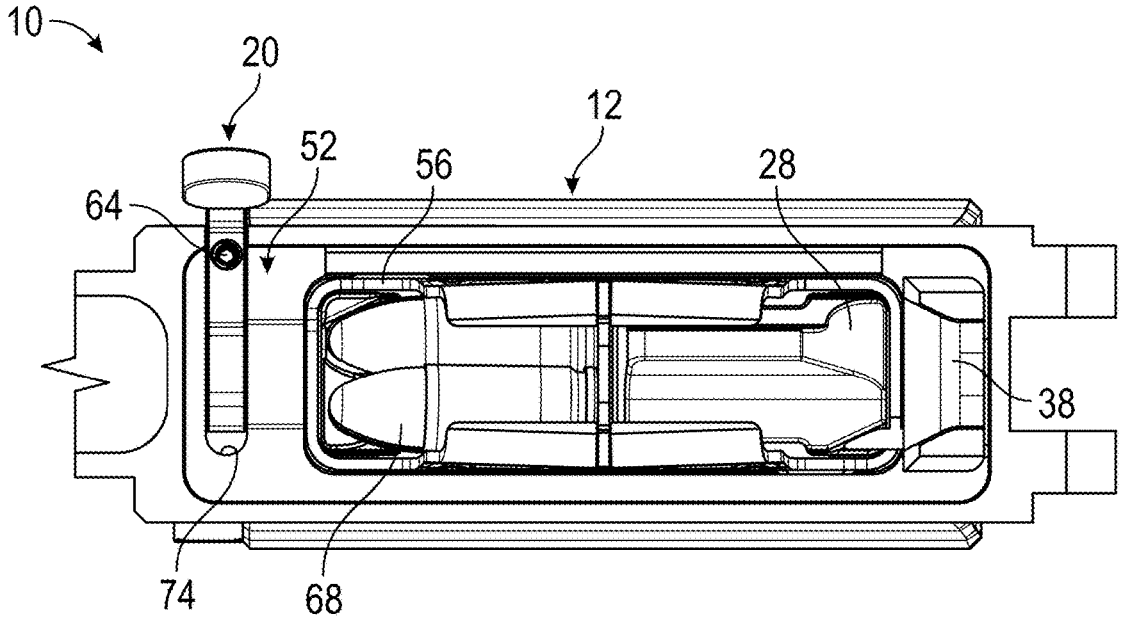
FIG. 6A is a top partial enlarged view of the firearm with integrated lower receiver components of FIG. 1.
Figure 6B:
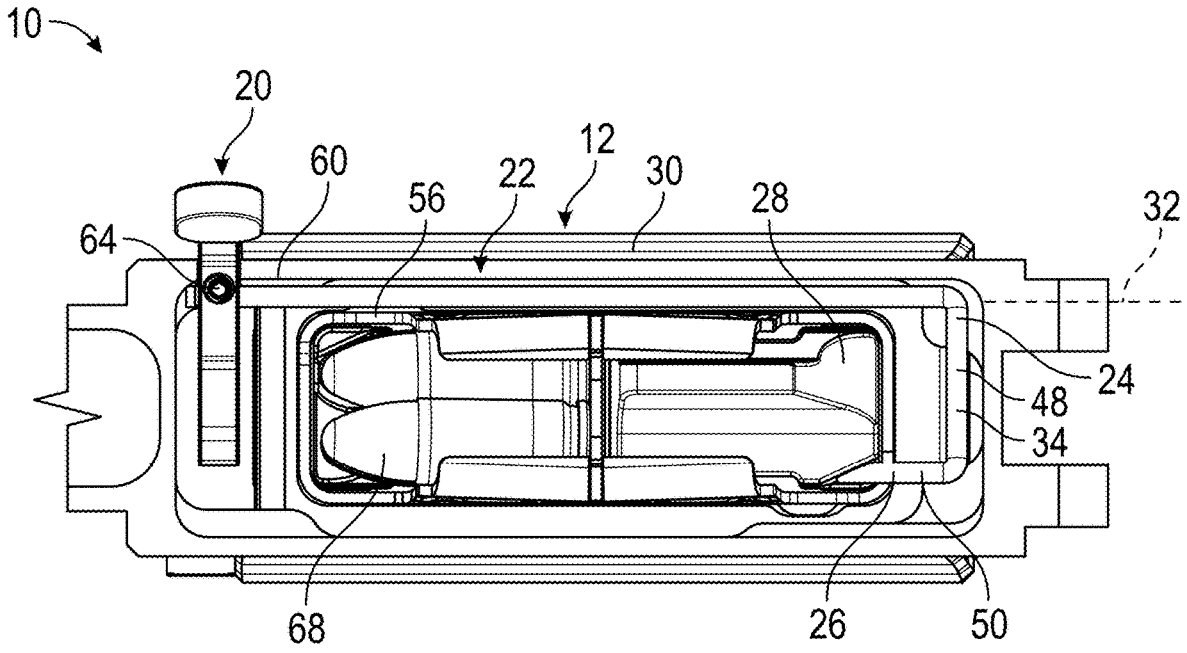
FIG. 6B is a top partial enlarged view of the firearm with integrated lower receiver components of FIG. 1 with the lower receiver insert omitted.

FIGS. 4A-5 illustrate the improved lower receiver insert 52 of the present invention. More particularly, FIG. 4A and the solid lines of FIG. 5 show the bolt hold open element 20 in the protruding position when the magazine 56 is empty, and FIG. 4B and the dashed lines of FIG. 5 show the bolt hold open element in the retracted position when the magazine has at least one round of ammunition 68. The bolt hold open element 20 rotates to move between a protruding position operable to restrain the reciprocating bolt assembly 18 rearward of the magazine well 54, and a retracted position operable to enable the reciprocating bolt assembly to move forward beyond a rear portion of the magazine well under the influence of the elongated link 22. The actuator portion 26 of the elongated link extending above the magazine well is lifted by the magazine follower 28 under the influence of a magazine spring 58 when the magazine 56 is empty, which causes the elongated link to rotate. It should be appreciated that when the magazine is a dual feed magazine as illustrated, the position of the forwardmost magazine follower 28 when the magazine is installed in the magazine well is what determines the position of the bolt hold open element. The position of the rearmost magazine follower does not affect the position of the bolt hold open element.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm with integrated lower receiver components has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame having a barrel extending in a forward direction and defining a bolt passage configured to receive a reciprocating bolt assembly;

the frame defining a magazine well;

a bolt hold open element movably connected to the frame to the rear of the magazine well and configured to move between a protruding position operable to restrain the reciprocating bolt assembly rearward of the magazine well, and a retracted position operable to enable the reciprocating bolt assembly to move forward beyond a rear portion of the magazine well;

an elongated link connected to the bolt hold open element;

a forward portion of the elongated link extending forward of the magazine well and having an actuator portion extending above the magazine well and configured to be actuated by a magazine follower;

the elongated link having a first elongated portion defining a link axis and received by the frame to rotate about the link axis;

the elongated link having an arm extending laterally from the first elongated portion and having a free end movable between an elevated and lowered position;

the free end of the arm including the actuator portion;

wherein the frame includes a feed ramp element at a forward portion of the magazine well; and wherein the feed ramp element defines an aperture receiving the actuator portion of the elongated link.

2. The firearm of claim 1 wherein the elongated link is a rod having a circular cross-sectional profile.

3. The firearm of claim 2 wherein the entire elongated link has a circular cross-sectional profile.

4. The firearm of claim 2 wherein the rod extends to the actuator portion.

5. The firearm of claim 1 wherein the frame has a left side and a right side, and wherein the first elongated portion is left of the magazine well, and the actuator portion is above a right portion of the magazine well.

6. The firearm of claim 1 wherein the magazine well has a width, and the arm has a length at least ¾ of the width of the magazine well.

7. The firearm of claim 1 wherein the magazine well has a width, and the arm extends the width of the magazine well.

8. The firearm of claim 1 wherein the elongated link includes a third portion extending rearward from the arm.

9. A firearm comprising:

a frame having a barrel extending in a forward direction and defining a bolt passage configured to receive a reciprocating bolt assembly;

the frame defining a magazine well;

a bolt hold open element movably connected to the frame to the rear of the magazine well and configured to move between a protruding position operable to restrain the reciprocating bolt assembly rearward of the magazine well, and a retracted position operable to enable the reciprocating bolt assembly to move forward beyond a rear portion of the magazine well;

an elongated link connected to the bolt hold open element;

a forward portion of the elongated link extending forward of the magazine well and having an actuator portion extending above the magazine well and configured to be actuated by a magazine follower;

the elongated link having a first elongated portion defining a link axis and received by the frame to rotate about the link axis;

the elongated link having an arm extending laterally from the first elongated portion and having a free end movable between an elevated and lowered position;

the free end of the arm including the actuator portion;

wherein the elongated link is a rod having a circular cross-sectional profile; and wherein the entire elongated link has a circular cross-sectional profile.

10. A firearm comprising:

a frame having a barrel extending in a forward direction and defining a bolt passage configured to receive a reciprocating bolt assembly;

the frame defining a magazine well;

a bolt hold open element movably connected to the frame to the rear of the magazine well and configured to move between a protruding position operable to restrain the reciprocating bolt assembly rearward of the magazine well, and a retracted position operable to enable the reciprocating bolt assembly to move forward beyond a rear portion of the magazine well;

an elongated link connected to the bolt hold open element;

a forward portion of the elongated link extending forward of the magazine well and having an actuator portion extending above the magazine well and configured to be actuated by a magazine follower;

the elongated link having a first elongated portion defining a link axis and received by the frame to rotate about the link axis, the first elongated portion being constrained without relative movement with respect to the frame other than rotation;

the elongated link having an arm extending laterally from the first elongated portion and having a free end movable between an elevated and lowered position;

the free end of the arm including the actuator portion; and wherein the frame has a left side and a right side, and wherein the first elongated portion is left of the magazine well, and the actuator portion is above a right portion of the magazine well.

11. The firearm of claim 10 wherein the elongated link is a rod having a circular cross-sectional profile.

12. The firearm of claim 11 wherein the entire elongated link has a circular cross-sectional profile.

13. The firearm of claim 11 wherein the rod extends to the actuator portion.

14. The firearm of claim 10 wherein the frame includes a feed ramp element at a forward portion of the magazine well.

15. The firearm of claim 14 wherein the feed ramp element defines an aperture receiving the actuator portion of the elongated link.

16. The firearm of claim 10 wherein the magazine well has a width, and the arm has a length at least ¾ of the width of the magazine well.

17. The firearm of claim 10 wherein the magazine well has a width, and the arm extends the width of the magazine well.

18. The firearm of claim 10 wherein the elongated link includes a third portion extending rearward from the arm.

* * * * *